US005524843A

United States Patent [19]

McCauley

[11] Patent Number: 5,524,843

[45] Date of Patent: Jun. 11, 1996

[54] WINDING DEVICE FOR WEB STRUCTURE SUCH AS WALLPAPER

[76] Inventor: Pat McCauley, 1369 Bonair Rd., Vista, Calif. 92083

[21] Appl. No.: 354,109

[22] Filed: Dec. 6, 1994

[51] Int. Cl.[6] ..... B65H 18/10

[52] U.S. Cl. ..... 242/532.6; 242/533.8; 242/546; 242/537; 242/597.6

[58] Field of Search ..... 242/405.3, 390.8, 242/532.6, 533.8, 546, 539, 537, 597.5, 597.6, 597.8, 587.2, 587.3, 222

[56] References Cited

U.S. PATENT DOCUMENTS

| | | | |
|---|---|---|---|
| 1,419,826 | 6/1922 | DiComo . | |
| 1,888,301 | 11/1932 | Waller | 242/222 |
| 1,977,103 | 10/1934 | Wise | 242/532.6 X |
| 2,696,335 | 12/1954 | Fies | 242/532.6 X |
| 3,113,742 | 12/1963 | Bevan et al. . | |
| 3,516,618 | 6/1970 | Reinke | 242/546 X |
| 3,934,834 | 1/1976 | Gick et al. | 242/597.5 X |
| 4,290,584 | 9/1981 | Eckels et al. | 254/380 |
| 4,915,320 | 4/1990 | Neal | 242/405.3 X |
| 4,951,890 | 8/1990 | Sossamon . | |
| 5,139,160 | 8/1992 | Romano . | |
| 5,190,237 | 3/1993 | Fagan . | |
| 5,376,035 | 12/1994 | Forrest | 242/390,8 X |

*Primary Examiner*—John M. Jillions
*Attorney, Agent, or Firm*—Tom Hamill, Jr.

[57] ABSTRACT

A winding device is provided for winding a web to expose its underside. When wallpapering, rolled prepasted wallcovering is first cut into appropriate lengths. The cut lengths have a memory of their rolled condition and tend to automatically re-roll into the rolled condition with the dry adhesive oriented internally. The winding device of the instant invention permits the wallcovering to be rolled into a condition with the dry adhesive oriented externally as to permit the subsequent wetting and application of the wallpaper. A rectangular member with a centrally disposed slot is provided to be adapted to a hand held rotary device such as an electric screwdriver or drill. The rectangular member may be substantially flat. The slot is designed to receive the first end of a web such as wallpaper. The elongated slot may be modified by a semi-triangular guide element to permit the web to be threaded thereto in a more efficient manner. An adapter element is provided on the rectangular member which is designed to be received in the socket of a hand held rotary device such as an electric screwdriver or drill. By engaging the electric rotary device, the rectangular member rotates, thus winding the web about the rectangular member. This reverses the orientation of the web, exposing the dry adhesive. The rectangular member may be comprised of any suitable material including metals, plastics or organic materials.

13 Claims, 3 Drawing Sheets

WINDING DEVICE FOR WEB STRUCTURE SUCH AS WALLPAPER

BACKGROUND OF THE INVENTION

1. Field of the Invention

The present invention relates generally to winding devices, and more particularly, to a winding device to be employed with a hand held rotary device especially adapted to effect the winding of a web such as wallpaper.

2. Description of the Prior Art

Winding devices which are attached to rotary devices such as hand held electric drill or screwdrivers are known in the art. U.S. Pat. No. 5,190,237 discloses a kite reel operable by an electric screwdriver. The screwdriver rotates a generally cylindrical spool. U.S. Pat No. 4,951,890 discloses an apparatus for unwinding a fishing line utilizing a spool constructed from a used cylindrical beverage container. The drill rotates a generally cylindrical container. U.S. Pat. No. 4,290,548 discloses a pole mounted winch which is operated by a hand held electric drill. The spool is cylindrical.

Thus, while the foregoing body of prior art indicates it to be well known to use electric rotary devices to rotate a cylindrical spool to wind or unwind a wire or line, the provision of a device for winding a web is not contemplated. Nor does the prior art described above teach or suggest a rectangular flat element with a generally elongated slot in combination with an electric hand held rotary device which may be used by individuals in the wallpapering industry. The foregoing disadvantages are overcome by the unique combination of the present invention as will be made apparent from the following description thereof. Other advantages of the present invention over the prior art also will be rendered evident.

SUMMARY OF THE INVENTION

Wallpaper comes in tightly wound cylindrical rolls and has an ornamental print located on one side of a web and a dry adhesive located on the opposite side of the web. The ornamental print is facing outwardly and the dry adhesive is facing inwardly when the wallpaper is in such a rolled condition. During a wallpapering operation, wallpaper is cut in strips according to dimensional requirements such as the height of the wall. Due to the fact that the wallpaper was rolled, it has a memory of its rolled condition and tends to reroll in a loose fashion. The wallpaper rerolls in the same orientation as it was when previously rolled, with the ornamental print facing outwardly and the dry adhesive facing inwardly. Prior to the wetting of the wallpaper, the dry adhesive side must be facing outwardly.

Presently, the strips of wallpaper are manually wound to place the dry adhesive in an outwardly facing orientation. A first end on the loosely rolled strip of wallpaper is grasped in the hands of the worker and is rerolled with the dry adhesive orientated in an outwardly facing fashion. The difficulties associated with this manual rerolling process include increased labor costs, worker fatigue, and decreased efficiency. Also, if moisture is introduced to the loosely wound wallpaper by a workers hands, the adhesive would be activated, causing the paper to stick together.

To overcome the disadvantages of manual rolling and to achieve other advantages, the present invention, briefly described, provides a device for winding a web to expose its underside. As stated, while wallpapering, rolled prepasted wallcovering is first cut into appropriate lengths. The cut lengths tend to have a memory of their rolled condition and tend to automatically reroll into the rolled condition with the dry adhesive oriented internally. The winding device permits the wallcovering to be rolled into a condition with the dry adhesive oriented externally as to permit the subsequent wetting and application of the wallpaper. A rectangular member with a centrally disposed slot is provided to be adapted to a hand held rotary device such as an electric screwdriver or drill. The elongated slot is designed to receive the first end of a web such as wallpaper. The elongated slot may be modified by a semi-triangular guide element to permit the web to be threaded thereto in a more efficient manner. An adapter bit element is provided on the rectangular member which is designed to be received in the socket of a hand held rotary device such as an electric screwdriver or drill. By engaging the electric rotary device, the rectangular member rotates, thus winding the web about the rectangular member. This reverses the orientation of the web, exposing the dry adhesive. The rectangular member may be comprised of any suitable material including metals, plastics or organic materials.

Hand held electric rotary devices such as electric screwdrivers or drills have a rotating drive means generally comprising a motor driven chuck which generally receives a drill bit or various screwdriver elements. The motor driven chuck has an aperture designed to receive the bit member which may be several different configurations, such as cylindrical, square or hexagonal. The adapter bit element may be cylindrical, square or hexagonal, depending on which rotary device is employed. It is appreciated that other chuck aperture geometries exist and that the adapter bit element may be designed to fit any configuration.

The adapter bit element may be attached to the rectangular member through any of a variety of attachment means including fasteners, adhesives or mechanical interfit. The adapter bit and the rectangular member may also be of unitary construction. It is understood that strengthening support elements may be provided at the point of attachment as to strengthen the area of attachment to prevent failure due to fatigue, stress or shock.

Wallpaper comes in rolls and is known as prepasted wall covering. One side of the wallpaper has an ornamental appearance and the other side of the web has a dry adhesive. The wallpaper is cut into appropriate lengths prior to wetting. The wallpaper has a memory which causes it to curl up into a roll once it is cut. The ornamental side is pointed outward. Currently the wallpaper is manually reverse rolled to expose the adhesive side prior to the wetting of the wallpaper and subsequent booking. By utilization of the instant invention, the wallpaper may be easily and simply reverse rolled with a significant savings of time and manual energy.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention is to provide a winding device with a flat spool element with an elongated slot thereon, including an adapter element for a hand held rotary device such as an electric screwdriver or drill.

A further object of the present invention is to provide a winding device where the elongated slot is provided with means to permit the web to be threaded thereto in an efficient and simple fashion.

A further object of the present invention is to provide a winding device which would permit considerable labor savings during a wallpapering process by permitting the laborer to utilize the winding device to reverse roll previously cut wallpaper elements as to expose their dry adhesive surfaces.

it is another object of the present invention to provide a winding device which has all of the advantages of the prior art and none of the disadvantages.

It is another object of the present invention to provide a winding device which may be easily and efficiently manufactured and marketed.

It is a further objective of the present invention to provide a winding device which is of durable and reliable construction.

An even further object of the present invention is to provide a winding device which is susceptible of a low cost of manufacture with regard to both materials and labor, and which accordingly is then susceptible of low prices of sale to the consuming public, thereby making such a winding device available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

With reference now to the drawings, winding device embodying the principles and concepts of the present invention will be described.

Figure 1:
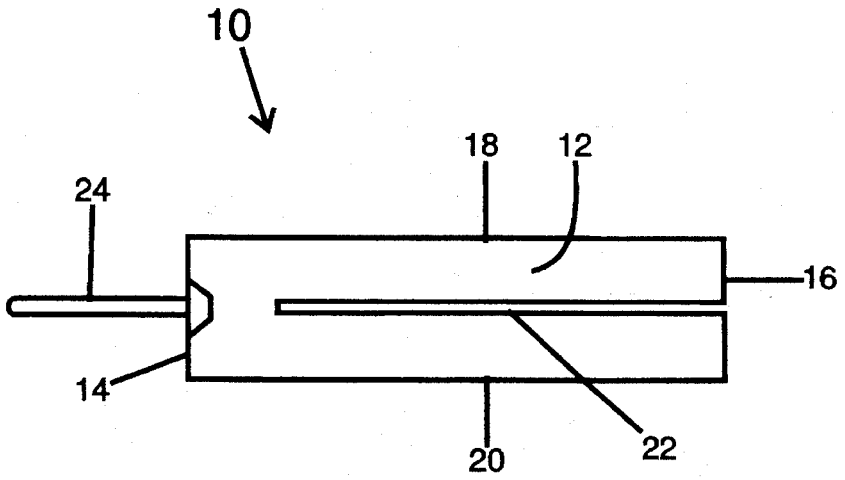
FIG. 1 is a perspective view showing the preferred embodiment of the winding device of the invention.

Turning initially to FIG. 1 there is shown a first exemplary embodiment of the winding device of the invention generally designated by reference numeral 10. In its preferred form, winding device 10 comprises a generally rectangular element 12. The rectangular element 12 has a first end 14, a distal end 16, a first side 18, a second side 20, and oppositely disposed wide, flat sides of a dimension more than about five times the thickness of the element. The rectangular element 12 has an elongated slot 22 centrally disposed thereon, the elongated slot 22 extending down the center line from the distal end 16 to proximal or near the first end 14. An adapter bit element 24 is attached to the first end 14. The adapter bit element 24 will be secured in a rotatable chuck of a hand held rotary device as will be discussed below.

Figure 2:
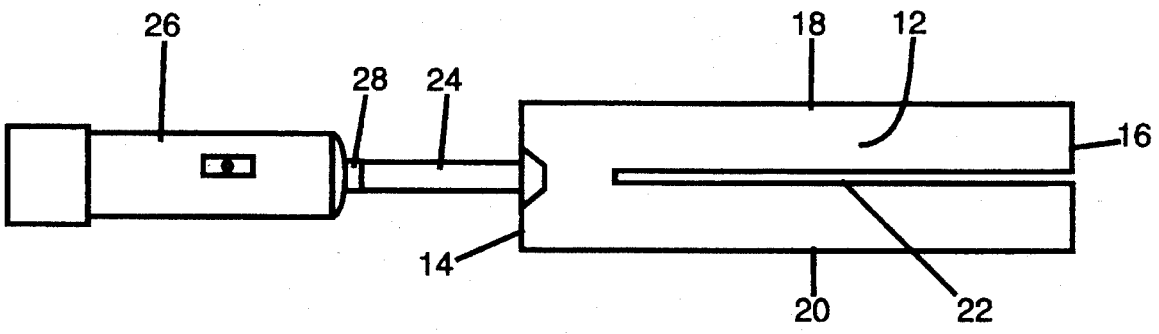
FIG. 2 is a view showing the winding device of the preferred embodiment of the invention attached to a hand held rotary device.

FIG. 2 shows the winding device 10 attached to a hand held rotary device 26. Hand held rotary device 26 may be a screwdriver, drill or other rotating power tool. It may be powered by alternating current or direct current and is preferably hand held. A rotatable chuck 28 receives the adapter bit element 24 in a secure fashion. The rotatable chuck 28 may come in several different configurations, such as hexagonal, square or circular. It is proposed that the adapter bit element 24 may be configured in any of the standard geometric configurations and may be chosen to mate with a specific rotatable chuck configuration.

Figure 3:
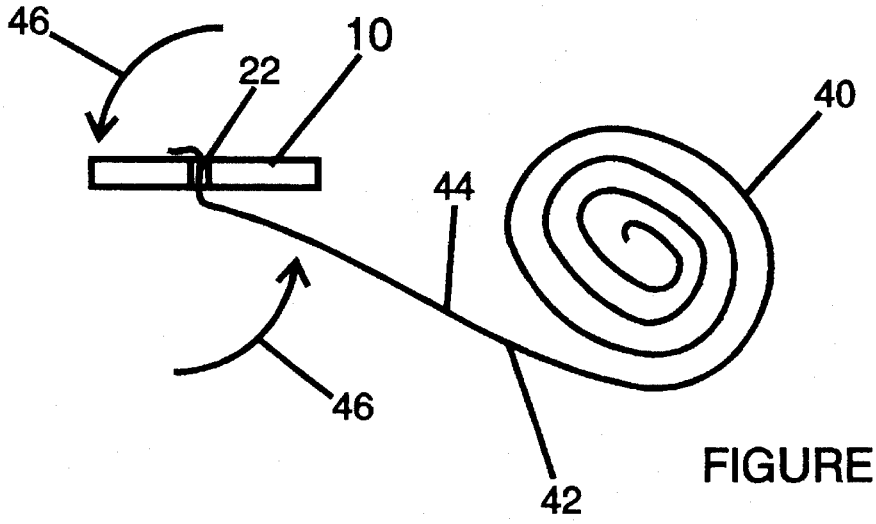
FIG. 3 is a view showing the web (wallpaper) being threaded through the elongated slot of the invention.
Figure 4:
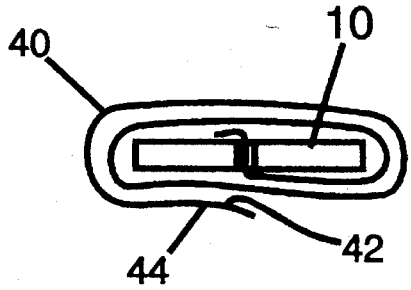
FIG. 4is a view showing the web (wallpaper) loosely wound about the rectangular element of the invention.
Figure 5:
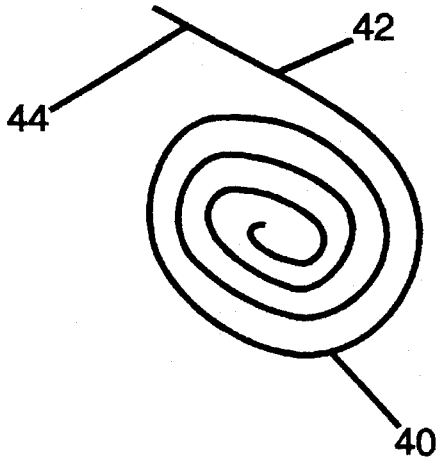
FIG. 5 is a view of the cut web showing the dry adhesive orientated toward the interior, prior to winding.
Figure 6:
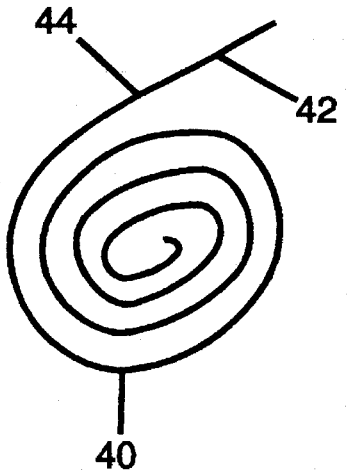
FIG. 6 is a view of the cut web showing the dry adhesive orientated toward the exterior, after it has been wound and removed from the winding device.

Turning now to FIGS. 3 and 4, the winding device 10 is shown interacting with a web 40. The web 40 may be, but is not limited to, wallpaper. The wallpaper 40 has a first side 42 with an ornamental pattern printed thereon and a second side 44 with a dry adhesive layer thereon. FIG. 3 shows the web 40 threaded in the elongated slot 22 with the ornamental print 42 orientated outwardly and the adhesive layer 44 orientated inwardly. Arrows 46 indicate the direction of rotation imparted to the winding device 10 by the hand held rotary device 26. By winding the wallpaper 40 about the winding device 10, the adhesive layer 44 is brought into an outward orientation and the ornamental print 42 is brought to an interior orientation. FIG. 5 shows the wallpaper web 40 before the winding process and FIG. 6 shows the wallpaper web 40 after the winding process.

Figure 7:
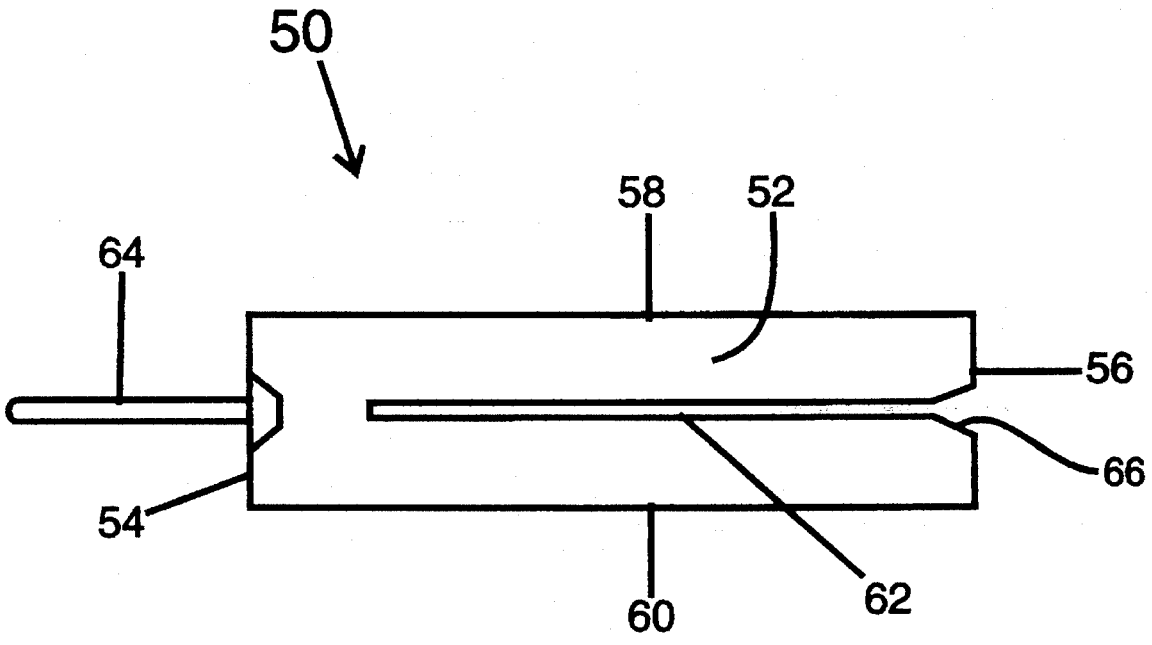
FIG. 7 is a perspective view of an embodiment of the invention showing the web guide element.

Turning now to FIG. 7 there is shown a second exemplary embodiment of the winding device of the invention generally designated by reference numeral 50. In its preferred form, winding device 50 comprises a generally rectangular element 52. The rectangular element 52 has a first end 54, a distal end 56, a first side 58, a second side 60, and oppositely wide, flat sides of a dimension more than about five times the thickness of the element. The rectangular element 52 has an elongated slot 62 centrally disposed thereon, the elongated slot 62 extending down the center line from the distal end 56 to proximal or near the first end 54. An adapter bit element 64 is attached to the first end 54. The adapter bit element 54 will be secured in a rotatable chuck of a hand held rotary device as discussed above. Guide element 66 is provided on the distal end 56. The guide element 66 may be, but is not limited to, a generally triangular geometry. Guide element 66 will permit the wallpaper to be threaded on the elongated slot 62 with a greater efficiency saving time.

It is also noted that in the final design that elements strengthening the adapter bit element's 14 connection to the first end 14 may be required. These strengthening means may include, but is not limited to, ribbing, additional structural material, or material with greater strength characteristics.

It is apparent from the above that the present invention accomplishes all of the objectives set forth by providing a new and improved winding device with a flat spool element with an elongated slot thereon, including an adapter element for a hand held rotary device such as an electric screwdriver or drill which would permit considerable labor savings during a wallpapering process by permitting the laborer to utilize the winding device to reverse roll previously cut wallpaper elements as to expose their dry adhesive surfaces.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A portable, hand held winding device to roll a strip of wallpaper, said winding device being attached to a hand held electric rotary device having a rotatable chuck, comprising:

a wide, flat rectangular element, said rectangular element having a first end, a distal end, and oppositely disposed wide, flat sides, said flat sides being of a dimension more than about five times the thickness of said element, an elongated slot, said slot centrally disposed and extending along the length of said rectangular element and through said flat sides of said rectangular element, said elongated slot extending from said distal end to proximal said first end, said slot separating said rectangular element into a first section and a second section, an adapter bit element, said adapter bit element disposed on said first end, said adapter bit element to be received in the rotatable chuck of the hand held electric rotary device, whereby, the first end of a strip of wallpaper is received in said elongated slot and said adapter bit element is received in the chuck of the hand held electric rotary device in such a manner that the chuck rotates said rectangular element thus winding the strip of wallpaper about said rectangular element.

2. The winding device as claimed in claim 1 wherein said elongated slot includes a guide element located on said distal end of said rectangular element.

3. The winding device as claimed in claim 2 wherein said guide element is triangular.

4. The winding device as claimed in claim 1 wherein said first end includes strengthening elements about said rectangular element and said adapter bit element.

5. The winding device as claimed in claim 1 wherein the adapter bit element is hexagonal.

6. The winding device as claimed in claim 1 wherein the adapter bit element is cylindrical.

7. The winding device as claimed in claim 1 wherein the adapter bit element is rectangular.

8. The winding device as claimed in claim 1 wherein said rectangular elements is manufactured from one of the group consisting of plastics, metals and organic materials.

9. In a portable, hand held winding device for winding a web such as wallpaper the combination comprising:

a hand held electric rotary device having a rotating chuck, said chuck having an aperture, a spool, said spool including a rectangular element, said rectangular element having a first end, a distal end and wide, flat, oppositely disposed sides, said flat sides being of a dimension more than about five times the thickness of said element, an elongated slot, said slot centrally disposed and extending along the length of said rectangular element and through said wide, flat, sides of said rectangular element, said elongated slot extending from said distal end to proximal said first end, said slot separating said rectangular element into a first section and a second section, an adapter bit element, said adapter bit element disposed on said first end, said adapter bit element to be received in said aperture and secured therein, whereby, the first end of a strip of wallpaper is received in said elongated slot and by engaging said rotary electric device is wound about said spool.

10. The winding device as claimed in claim 9 wherein said elongated slot includes a guide element located on said distal end of said rectangular element.

11. The winding device as claimed in claim 10 wherein said guide elements is substantially triangular.

12. The winding device as claimed in claim 9 wherein said electric rotary device includes a hand held electric screwdriver.

13. The winding device as claimed in claim 9 wherein said electric rotary device includes a hand held electric drill.

* * * * *